United States Patent [19]

Lawrence et al.

[11] Patent Number: 4,490,004

[45] Date of Patent: Dec. 25, 1984

[54] CONNECTOR FOR CONNECTING INSULATED WIRES TO A CIRCUIT BOARD

[75] Inventors: John T. Lawrence; John C. Swartz, both of Harrisburg, Pa.

[73] Assignee: AMP Incorporated, Harrisburg, Pa.

[21] Appl. No.: 407,011

[22] Filed: Aug. 11, 1982

[51] Int. Cl.[3] ..... H01R 11/01

[52] U.S. Cl. ..... 339/95 R; 339/97 P; 339/176 MP

[58] Field of Search ..... 339/176 MP, 97 R, 97 P, 339/98, 99 R, 95 R

[56] References Cited

U.S. PATENT DOCUMENTS

| | | | |
|---|---|---|---|
| 4,026,013 | 5/1977 | Hughes | 339/97 R |
| 4,038,573 | 7/1977 | Hillyer et al. | 339/97 P |
| 4,094,573 | 6/1978 | Langham | 339/176 MP |
| 4,118,103 | 10/1978 | Leidy et al. | 339/98 |
| 4,130,331 | 12/1978 | Neff et al. | 339/97 R |
| 4,147,398 | 4/1979 | Lill | 339/98 |
| 4,166,265 | 8/1979 | Reynolds et al. | 336/192 |
| 4,183,607 | 1/1980 | Hughes | 339/98 |
| 4,272,146 | 6/1981 | Simon et al. | 339/176 MP |
| 4,340,829 | 7/1982 | McCoy | 339/97 R |

FOREIGN PATENT DOCUMENTS

| | | | |
|---|---|---|---|
| 2743242 | 3/1978 | Fed. Rep. of Germany | 339/97 R |

OTHER PUBLICATIONS

AMP Mag-Mate Interconnect System Handbook, HB 5483, Published Sep., 1980, p. 1.

*Primary Examiner*—John McQuade
*Assistant Examiner*—Thomas M. Kline
*Attorney, Agent, or Firm*—F. W. Raring

[57] ABSTRACT

Multi-contact connector for connecting wires to terminal pads on a circuit board comprises a housing having a trough-like opening extending into its circuit board receiving face. Terminal receiving cavities extend into the circuit board receiving face at spaced-apart intervals. The terminals are U-shaped and have wire-receiving slots extending inwardly from one end. A leaf spring is provided at the other end for contacting a terminal pad. Wire-admitting slots are provided in the housing and extend into the circuit board receiving face and the adjacent sidewalls. In use, a wire is positioned in the wire-admitting slots and the terminal is then inserted into the cavity. The wire is received in the wire-receiving slots and thereby connected to the terminal. When the circuit board is inserted into the trough-like opening, a spring contact on the terminal will engage a terminal pad.

6 Claims, 7 Drawing Figures

8
6
10
12
14
2
18
36
28
73
16
76
48
26
22
78
78
74

CONNECTOR FOR CONNECTING INSULATED WIRES TO A CIRCUIT BOARD

FIELD OF THE INVENTION

This invention relates to multi-contact electrical connectors for connecting individual wires to the terminal pads on a circuit board. The embodiment described in detail below is particularly intended for connecting wires extending from a coil, such as a transformer coil, to terminal pads on a circuit board. However, the principles of the invention can be used under many other circumstances.

BACKGROUND OF THE INVENTION

Control circuits for many types of electrical equipment which are provided on a circuit board frequently require a power transformer. If the transformer is not unduly large, it can be mounted on the circuit board along with the circuit components and the connections made from the transformer to the components through the conductors on the circuit board. If, however, the transformer is relatively heavy and bulky, it is impractical to mount it on the circuit board and it is necessary to mount the transformer in an adjacent location. The wires of the transformer must then be connected by lead wires to the terminal pads and this may entail the use of an additional connector on the circuit board. The specific embodiment of the present invention disclosed herewith and described below provides a simplified method of connecting wires extending from a coil, such as a transformer coil, to terminal pads on a circuit board. The principles of the invention can, however, be used under other circumstances to connect wires to terminal pads on a circuit board.

The invention comprises a multi-contact electrical connector for connecting wires to terminal pads on a circuit board, the terminal pads being arranged in a row which extends along one edge of the circuit board. The connector is of the type comprising an insulating housing having a board-receiving face and a rearward face, first and second sidewalls extending between the faces and endwalls at the ends of the housing. A trough-like board-receiving opening extends into the board-receiving face and is dimensioned to receive the one edge of the circuit board. A row of spaced-apart terminal receiving cavities are provided in the housing, the row of cavities extending beside the board-receiving opening. The terminals are dimensioned to be received in the terminal-receiving cavities, each terminal having a wire connecting end and a contact end and having wire connecting means at its wire connecting end and contact means at its contact end for contacting the terminal pad on the circuit board. A connector in accordance of the invention is particularly characterized in that the terminal-receiving cavities extend into the housing from the board-receiving face and have inner ends which are proximate to the rearward face of the housing. Circuit board stop means are provided in the board-receiving opening and located between the inner ends of the cavities and the board-receiving face of the housing. Each cavity has associated therewith aligned first and second wire-admitting slots which extend into the housing from the board-receiving face, the first and second wire-admitting slots also extending inwardly from the first and second sidewalls respectively. Wire stop means are provided for each cavity and located between the inner end of the cavity and the circuit board stop means so that a wire can be moved laterally of its axis towards the board-receiving face and into the wire-admitting slots. The wire will then extend through the associated cavity at a location between the inner end of the cavity and the circuit board stop. The wire connecting means on each terminal comprises a wire-receiving slot extending inwardly in the terminal from the wire connecting end. Upon placement of the wires in the wire-admitting slots and insertion of a terminal into each of the cavities, the wires will be received in the wire-receiving slots and thereby connected to the terminals. Upon insertion of the one edge of the circuit board into the board-receiving opening, the contact springs of the terminals will contact the terminal pads on the circuit board.

In accordance with further embodiments, each terminal comprises at least one plate-like sheet metal member, the contact means comprising a leaf spring which is integral with and extends from the contact end of the terminal. In accordance with a further embodiment, each terminal comprises parallel spaced-apart first and second plate-like members and spaced-apart connecting straps extending between, and integral with, the plate-like members at the wire connecting end of the terminal, each of the plate-like members having a wire-receiving slot therein.

In accordance with a further embodiment, the housing is integral with a coil support of insulating material.

Figure 1:
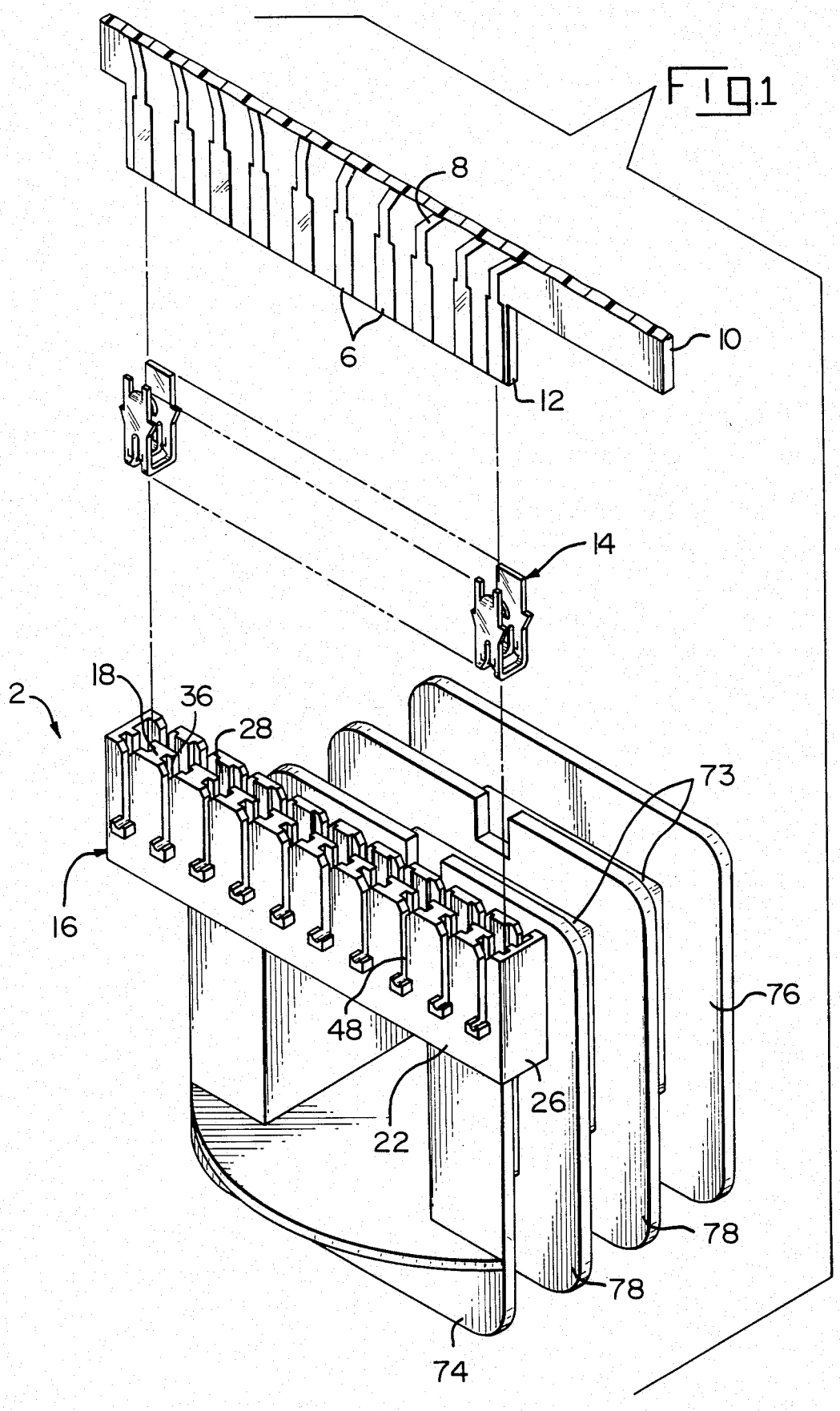
FIG. 1 is a perspective view showing a coil support or bobbin having a connector in accordance with the invention integral with one of its flanges and showing electrical contact terminals exploded from the connector and portions of a circuit board in alignment with the connector.

A connector 2 in accordance with the invention serves to connect coil wires 4 extending from a coil support to terminal pads 6 which in turn are provided on the ends of conductors 8 on a circuit board 10. The terminal pads 6 are arranged as a row extending along an edge portion 12 of the circuit board. The connections between the wires 4 and the terminal pads are effective by means of terminals 14 as will be described below.

The connector 2 comprises a housing 16 having a board-receiving face 18, a rearward face 20, first and second sidewalls 22, 24, and endwalls 26 which extend between the faces.

A trough-like board-receiving opening 28 extends into the face 18 and between the endwalls 26. This opening has opposed internal first and second sidewalls 30, 32, see FIG. 4, and has an inner end or floor 34 which functions as a stop for the circuit board 10 when it is inserted.

Figure 3:
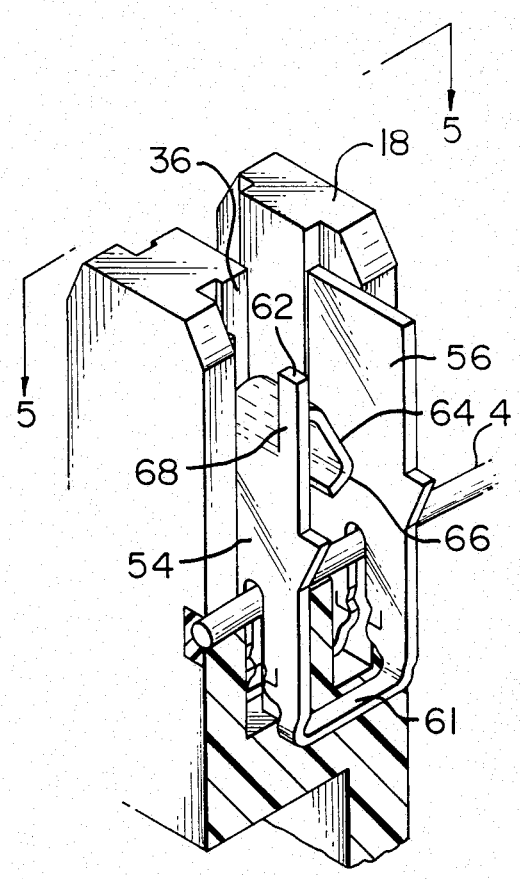
FIG. 3 is a view similar to FIG. 2 but showing the parts when the terminal is fully inserted into the cavity.
Figure 4:
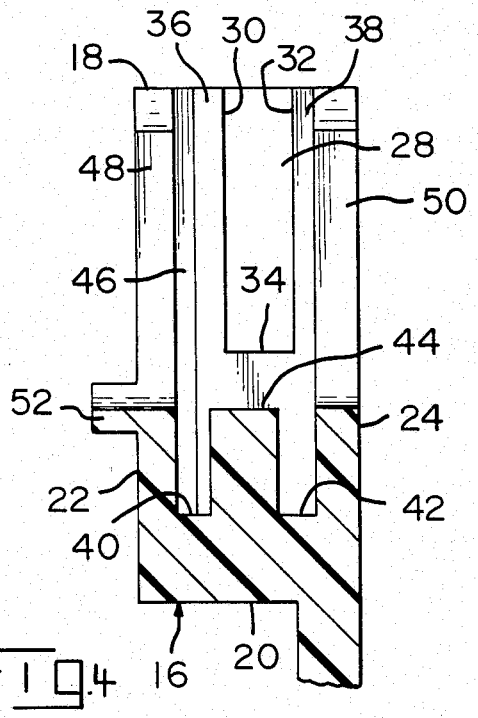
FIGS. 4 and 5 are views taken along lines 4—4 and 5—5 of FIGS. 2 and 3 respectively.
Figure 5:
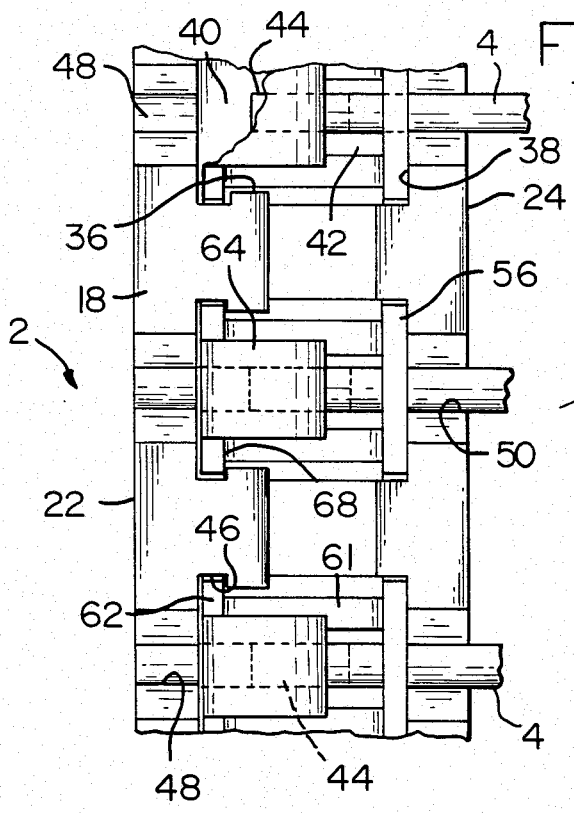

A plurality of spaced-apart terminal receiving cavities 36, 38 extend inwardly from the board-receiving face 18 and intersect the trough-like opening 28. As shown in FIGS. 3 and 4, each cavity has a portion 38 which is to the right of the trough-like opening 28 as viewed in FIG. 4, and a portion 36 which is to the left of the opening 28. Each cavity has an inner end as shown at 40, 42, the inner end being below the level of the floor 34 of the trough-like opening so that the floor 34 is between the face 18 and the inner ends 40, 42 of the cavities.

A wire stop or wire support surface 44 is provided between the inner end portions 40, 42 of each cavity and comprises a surface which faces towards the board-receiving face 18. The surface 44 is between the stop surface 34 and and inner end 40, 42 of the cavity.

The portion 36 of each cavity which is proximate to the sidewall 22 has opposed cavity walls that extend normally of the sidewall 30 of the opening 28. Opposed grooves are provided in these cavity walls as shown in 46 and extend downwardly as viewed in FIG. 4 to the inner end portion 40 of the cavity.

Figure 2:
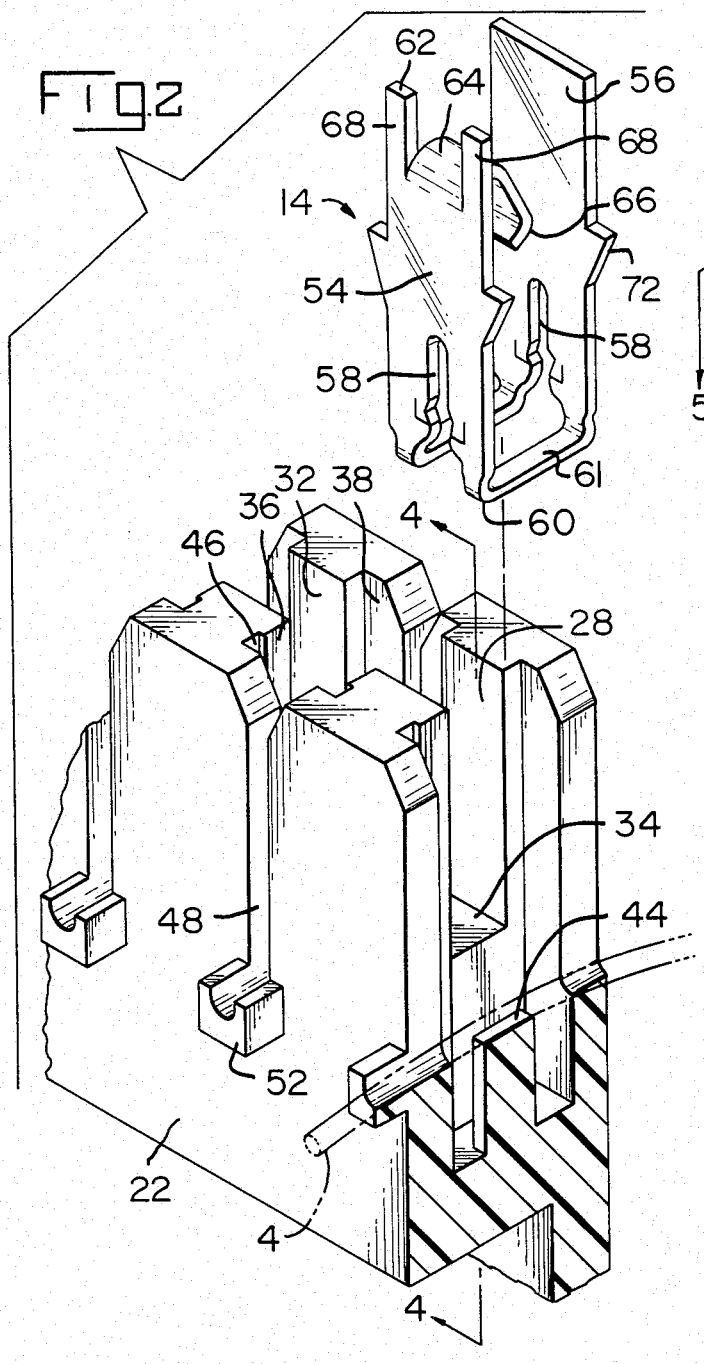
FIG. 2 is a fragmentary perspective view with parts broken away showing detail of the connector and showing a terminal exploded from the connector cavity.

First and second wire-admitting slots 48, 50 are associated with each of the terminal-receiving cavities, the first slot 48 extending inwardly from the face 18 and inwardly from the housing sidewall 22 so that this slot communicates with the cavity portion 36. The second wire-admitting slot 50 also extends inwardly from the face 18 and extends inwardly from the sidewall 24 so that it communicates with the portion 38 of the associated terminal-receiving cavity. A wire 4 can thus be positioned in alignment with the slots and moved laterally of its axis into the slots until it is supported at the inner ends of the wire-admitting slots and on the wire support surface 44 as indicated by the phantom lines in FIG. 2.

Figure 7:
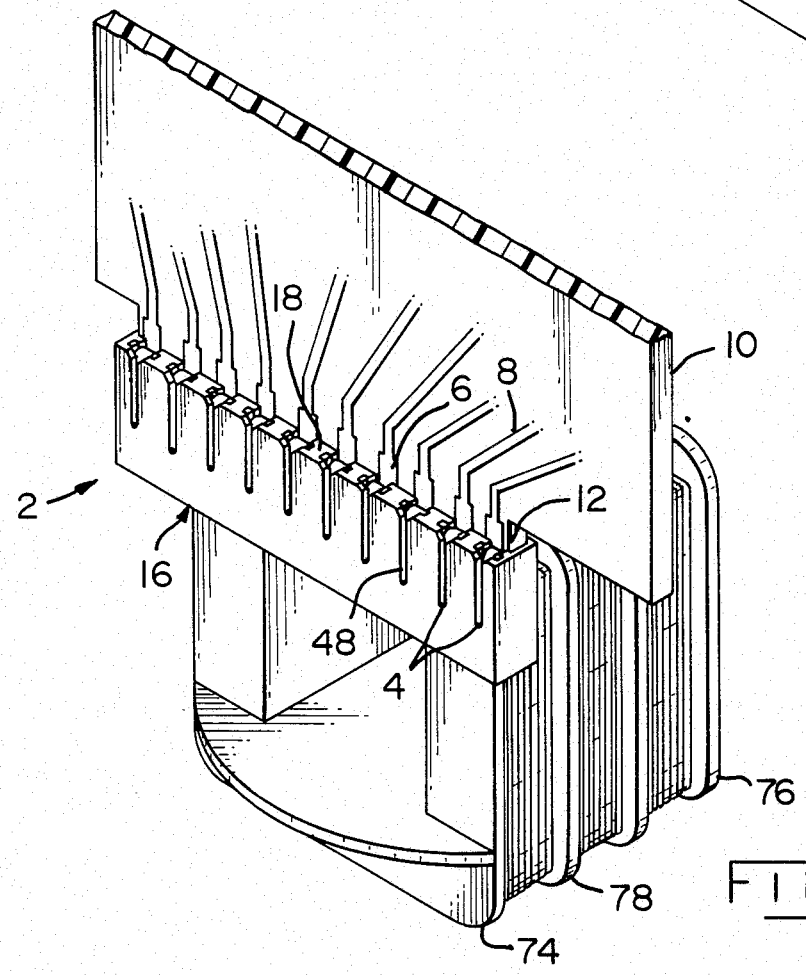
FIG. 7 is a perspective view showing the circuit board inserted into the connector.

Projections 52 are provided on the housing sidewall 22 in alignment with, and at the inner end of, each of the wire-admitting slots 48. These projections support the wires during cutting of the wires as shown in FIG. 7 and as described in detail in U.S. Pat. No. 4,166,265.

Each terminal 14 comprises first and second plate-like members 54, 56 which are in parallel spaced-apart relationship and which are connected at the lower ends as viewed in the drawing by spaced-apart connecting strap members 61. The lower end 60 is the wire connecting end of the terminal and each plate-like member has a wire-receiving slot 58 extending inwardly from the lower end of the terminal. The slots are dimensioned such that they will penetrate the insulation of the wire and establish electrical contact with the metallic core of the wire. The upper end 62 of the terminal is the contact end and the plate-like member 54 has an integral contact spring 64 which is reversely formed as shown and extends toward the plate-like member 56. The contact spring is again reversely formed as shown at 66 to form a contact portion which engages a terminal pad. The plate-like member has side edge portions 68 and the contact spring 64 is between the side edge portions. When the terminal is inserted into its associated cavity, the side edge portions are received in the grooves 46. Lances 72 extending from the side edges of the plate-like members penetrate the adjacent surfaces of the housing and prevent withdrawal or removal of the terminal after it is fully inserted. It will be apparent that the portion 38 of each cavity is dimensioned to receive the plate-like portion 56 of its associated terminal.

The bobbin or coil support has a coil supporting surface 73 and end flanges 74, 76, the housing 2 of the disclosed embodiment being integrally molded with the end flange 74. Separators 78 extend from the surface 73 and parallel to the flanges 74, 76. The separators separate the coils wound on the bobbin from each other and the ends of the coil wires extend from the individual coils to the connector as shown.

Figure 6:
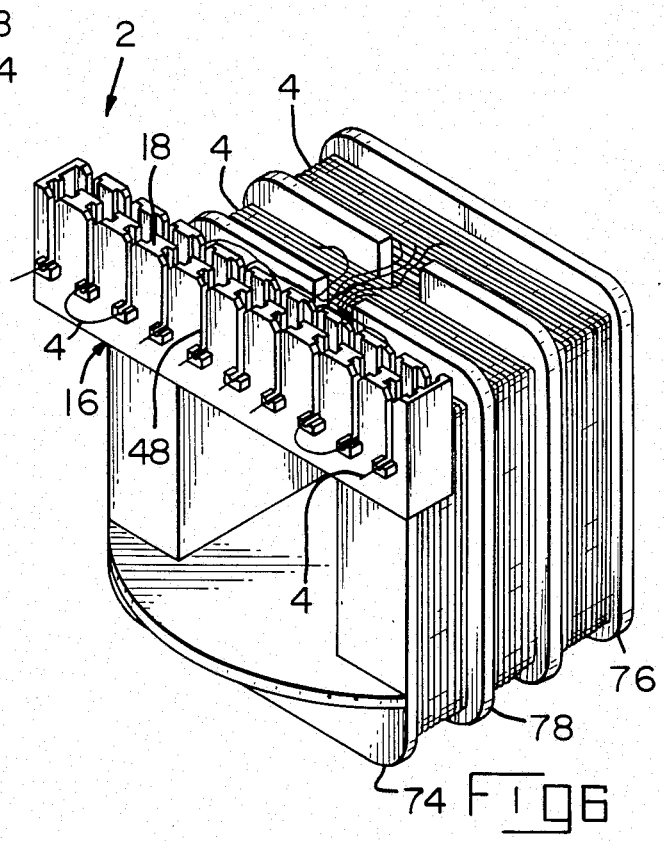
FIG. 6 is a view similar to FIG. 1 illustrating the manner of wiring coils on the coil support and positioning the wires in the connector in preparation for insertion of the terminals into the connector.

In use, and after the coils have been wound on the coil support, the coil wires are placed in the wire-admitting slots 48, 50 as shown in FIG. 6. After insertion, the wires will be supported on the surfaces 44 and they will be supported by the inner ends of the wire-admitting slots 48, 50. Thereafter, the individual terminals 14 are inserted into the cavities and when they are in the fully inserted positions, the wires will be received in the wire-receiving slots 58 and electrical contact will be established between the wires and the terminals. The portions of the wires extend beyond the surface of the sidewall 22 and then trimmed by simply moving a trimming or a shearing blade across the surface of the sidewall as explained in the above identified U.S. Pat. No. 4,166,265. During this trimming operation, the projections 52 are also trimmed so that the wires are flush with the surface of sidewall 22.

A circuit board 10 can then be inserted into the wire-receiving opening and the contact springs 64 of the terminals will contact terminal pads 6 of the circuit board.

The practice of the invention provides distinct advantages in connecting coil wires to components on a circuit board in that the ends of the coil wires are connected directly to the terminals which engage the terminal pads on the circuit board. The practice of the invention thus eliminates at least two electrical interfaces in connections of this type.

The use of the invention is not restricted to coil bobbins as previously explained. The invention may prove useful under many other circumstances where wires are to be connected to terminal pads.

We claim:

1. A multi-contact electrical connector for connecting wires to the terminal pads on a circuit board, the terminal pads being arranged in a row which extends along one edge of the circuit board, the connector being of the type comprising an insulating housing having a board-receiving face and a rearward face, first and second sidewalls extending between the faces and endwalls at the ends of the housing extending between the faces, a trough-like board-receiving opening extending into the board-receiving face which is dimensioned to receive the one edge of the board, the opening extending parallel to the sidewalls and between the endwalls, a row of spaced-apart terminal-receiving cavities in the housing, the row of cavities extending beside the board-receiving opening, and terminals dimensioned to be received in the terminal-receiving cavities, each terminal having a wire connecting end and a contact end, each terminal having wire connecting means for connecting the terminal to a wire at its wire-connecting end and having contact means at its contact end for contcting a terminal pad on the circuit board, the connector being characterized in that:

the terminal-receiving cavities extend into the housing from the board-receiving face and have inner ends which are proximate to the rearward face of the housing, circuit board stop means are provided in the board-receiving opening for engagement by the one edge of the circuit board, the circuit board stop means being located between the inner ends of the terminal-receiving cavities and the board-receiving face of the housing, each cavity has associated therewith aligned first and second wire-admitting slots which extend into the housing from the board-receiving face, the first and second wire-admitting slots extending inwardly from the first and second sidewalls respectively, wire stop means for locating wires in the slots, the wire stop means being between the inner end of the cavity and the circuit board stop means whereby a wire can be moved laterally of its axis towards the board-receiving face and into the wire-admitting slots and will extend through the associated cavity at a location between the inner end of the cavity and the circuit board stop means, each cavity having opposed cavity walls which extend in planes that extend normally of the board-receiving face and normally of the housing sidewalls, the opposed cavity walls having grooves therein, each terminal comprising at least one plate-like sheet metal member having side edge portion extending from the contact end to the wire-connecting end, the contact means comprising a leaf spring which is integral with, and extends from, the contact end of the terminal and is formed from portions of the plate-like member which are between the side edge portions, the wire connecting means on each terminal comprising a wire-receiving slot extending inwardly in the terminal from the wire-connecting end whereby, upon placement of the wires in the wire-admitting slots and insertion of a terminal into each of the cavities, wire-connecting end first, the side edge portions of the plate-like member will be received in the grooves and the wires will be received in the wire-receiving slots and thereby connected to the terminals, and upon insertion of the one edge of the circuit board into the board-receiving opening, the contact means of the terminals will contact the terminal pads on the circuit board.

2. A multi-contact electrical connector as set forth in claim 1 characterized in that the housing is integral with a flange of a coil bobbin.

3. A multi-contact electrical connector for connecting wires to the terminal pads on a circuit board, the terminal pads being arranged in a row which extends along one edge of the circuit board, the connector being of the type comprising an insulating housing having a board-receiving face and a rearward face, first and second sidewalls extending between the faces and endwalls at the ends of the housing extending between the faces, a trough-like board-receiving opening extending into the board-receiving face which is dimensioned to receive the one edge of the board, the opening extending parallel to the sidewalls and between the endwalls, a row of spaced-apart terminal-receiving cavities in the housing, the row of cavities extending beside the board-receiving opening, and terminals dimensioned to be received in the terminal-receiving cavities, each terminal having a wire connecting end and a contact end, each terminal having wire connecting means for connecting the terminal to a wire at its wire-connecting end and having contact means at its contact end for contacting a terminal pad on the circuit board, the connector being characterized in that:

the terminal-receiving cavities extend into the housing from the board-receiving face and have inner ends which are proximate to the rearward face of the housing, circuit board stop means are provided in the board-receiving opening for engagement by the one edge of the circuit board, the circuit board stop means being located between the inner ends of the terminal-receiving cavities and the board-receiving face of the housing, each cavity has associated therewith aligned first and second wire-admitting slots which extend into the housing from the board-receiving face, the first and second wire-admitting slots extending inwardly from the first and second sidewalls respectively, wire stop means for locating wires in the slots, the wire stop means being between the inner end of the cavity and the circuit board stop means whereby a wire can be moved laterally of its axis towards the board-receiving face and into the wire-admitting slots and will extend through the associated cavity at a location between the inner end of the cavity and the circuit board stop means, each terminal comprising parallel spaced-apart first and second plate-like members, spaced-apart connecting straps extending between, and integral with, the plate-like members at the wire connecting end of the terminal, the wire connecting means on each terminal comprising a wire-receiving slot in each of the plate-like members extending inwardly from the wire connecting end of the terminal, the plate-like members of each terminal having side edge portions extending from the contact end to the wire-connecting end, the contact means comprising a leaf spring which is integral with, and which extends from, the first plate-like member, the leaf spring being formed from portions of the first plate-like member which are between the side edge portions, each cavity having opposed cavity walls which extend in planes that extend normally of the board-receiving face and normally of the housing sidewalls, the opposed cavity walls having opposed aligned grooves therein whereby, upon placement of the wires in the wire-admitting slots and insertion of a terminal into each of the cavities, wire-connecting end first, the side edge portions of the plate-like members will be received in the grooves and the wires will be received in the wire-receiving slots and thereby connected to the terminals, and upon insertion of the one edge of the circuit board into the board-receiving opening, the contact means of the terminals will contact the terminal pads on the circuit board.

4. A multi-contact electrical connector as set forth in claim 3 characterized in that the wire stop means comprises a wire stop surface which faces towards the board-receiving face and which is between the first and second sidewalls.

5. A multi-contact electrical connector as set forth in claim 4, the housing being integral with an insulating coil support.

6. A multi-contact electrical connector as set forth in claim 5, the coil support being a coil bobbin, the housing being integral with a flange of the bobbin.

* * * * *